US006784867B1

(12) United States Patent
Chang

(10) Patent No.: US 6,784,867 B1
(45) Date of Patent: Aug. 31, 2004

(54) VOLTAGE-FED PUSH LLC RESONANT LCD BACKLIGHTING INVERTER CIRCUIT

(75) Inventor: Chin Chang, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 276 days.

(21) Appl. No.: 09/713,411

(22) Filed: Nov. 16, 2000

(51) Int. Cl.[7] ..... G09G 3/36; G09G 5/00
(52) U.S. Cl. ..... 345/102
(58) Field of Search ..... 345/102, 211–212; 363/95, 100, 167, 170

(56) References Cited

U.S. PATENT DOCUMENTS 4,920,302 A * 4/1990 Konopka ..... 315/307
5,239,293 A * 8/1993 Barbier ..... 345/95
5,428,265 A * 6/1995 Booth et al. ..... 315/158
5,719,474 A * 2/1998 Vitello ..... 315/307
5,939,830 A * 8/1999 Praiswater ..... 315/169.3
6,211,852 B1 * 4/2001 Oono et al. ..... 345/102
6,307,765 B1 * 10/2001 Choi ..... 363/134

FOREIGN PATENT DOCUMENTS

EP 0439862 A1 7/1991 ..... H05B/41/392
EP 0599598 A1 1/1994 ..... H05B/41/392

* cited by examiner

*Primary Examiner*—Richard Hjerpe
*Assistant Examiner*—Duc Q Dinh

(57) ABSTRACT

An improved electronic LCD backlighting inverter circuit for high frequency operation under low frequency pulse width modulation (PWM) for dimming control. The improved electronic LCD backlighting inverter is based on a voltage-fed push-pull LLC resonant inverter circuit configuration including a resonant inductor (L), magnetizing inductance of an output transformer (L), and resonant capacitor (C). For large values of magnetizing inductance the LLC circuit effectively becomes an LC resonant circuit. By synchronizing the high frequency switching signal and the low frequency modulation frequency using logic control circuitry, a wide dimming range and higher efficiency are achieved under PWM control.

22 Claims, 6 Drawing Sheets

VOLTAGE-FED PUSH LLC RESONANT LCD BACKLIGHTING INVERTER CIRCUIT

BACKGROUND OF THE INVENTION

1. Field of the Invention

The present invention relates generally to an electronic LCD backlighting inverter circuit suitable for LCD backlighting or the like, and more particularly, to an LCD backlighting inverter circuit which is highly efficient, has a low profile, and a wide dimming range.

2. Description of the Related Art

LCD backlighting applications demand efficient, low profile backlighting for information display. Narrow diameter cold-cathode fluorescent lamps (CCFL), such as the T1 type for example, are widely used in the industry for such applications. To drive these CCFLs, high frequency electronic LCD backlighting inverter circuits having high efficiency, low profile, and a wide dimming range are in demand. Presently, voltage-fed half bridge resonant converter circuits, as shown in FIG. 1, and current-fed push-pull resonant converter circuits, as shown in FIG. 2 are used to drive CCFL and other fluorescent lamps. Despite their wide use, these circuits have shortcomings which make them less than optimum solutions for driving CCFL's and the like. For example, the efficiency of these circuits is optimum and their dimming range is limited. In particular, a disadvantage of the prior art circuit configuration of FIG. 1 is a high output transformer turns ratio, which translates to a higher primary side winding current which leads to higher conduction losses. A further disadvantage of the circuit of FIG. 1 is that the high turns ratio in the secondary winding requires a reduced wire size (e.g., to 44 AWG) which contributes to higher conduction losses in the winding. In addition, a smaller gauge wire may cause problems during manufacturing. Another disadvantage of using a high turns ratio transformer is a significant increase in parasitic capacitance which leads to low efficiency. The typical electrical efficiency of the circuit of FIG. 1 is about 84% (i.e., output power/input power).

FIG. 2 is another prior art circuit configuration of a widely used electronic ballast for driving CCFLs. The backlight inverter of FIG. 2 has a smaller output transformer turns ratio than that described with reference to the circuit of FIG. 1, and is capable of current based lamp power dimming using a Buck regulator stage. While the smaller output transformer turns ratio will lead to smaller losses in the push-pull power stage, the total circuit efficiency is limited by the Buck regulator stage. Another disadvantage of the circuit of FIG. 2 is a narrow dimming range due to the thermometer effect in the LCD panel when the lamp current frequency is high. At higher frequencies, a parallel parasitic capacitance in the lamp shield draws more current from the lamp causing one end of the lamp to be bright and the other to be dim.

In order to improve circuit efficiency and achieve a wide dimming range it has been proposed to use the push-pull resonant inverter stage operated in a low frequency pulse width modulation (PWM) dimming mode and using the push-pull converter switches, Q1 and Q2, in FIG. 2 also as the low frequency switches for PWM dimming. However, the typically high inductance of L1 limits the circuit start up performance and limits the dimming range.

Accordingly, a need exists for an improved electronic LCD backlighting inverter circuit which is more efficient than a conventional electronic LCD backlighting inverter circuits having a wide dimming range, and low profile.

SUMMARY OF THE INVENTION

In accordance with the present disclosure, an improved electronic LCD backlighting inverter circuit for use in LCD backlighting applications is provided which obviates the problems associated with the prior art.

According to one aspect of the invention, there is provided an improved high frequency electronic LCD backlighting inverter circuit for powering a fluorescent lamp that is efficient, has a low profile, and a wide dimming range.

The improved high frequency electronic LCD backlighting inverter circuit can operate a load composed of cold cathode flourescent lamps or hot cathode flourescent lamps.

It is a feature of the present invention that the LCD backlighting inverter circuit is optimally designed for high frequency switching, however, the invention provides capabilities for low frequency pulse-width modulated (PWM) switching using logic control circuitry to achieve a wider frequency range than can be realized in conventional LCD backlighting inverter circuits. By controlling the dimming range via logic control circuitry the need for a current driven front end Buck regulator stage, as used in conventional current driven push-pull circuits is removed. That is, the present invention removes the need for a Buck regulator stage switching transistor and associated diode which contribute to low circuit efficiency. Further, the output transformer turns ratio is greatly reduced leading to higher circuit efficiency. Higher circuit efficiency is further realized by selecting an inductance value for L1 that is orders of magnitude lower than the value required in a conventional design. By choosing a smaller inductance value for L1, the inductor does not act as a current source, but instead is considered part of an LLC resonant circuit thereby providing the ability to switch the inventive circuit off at the zero-crossings of the inductance current. By selecting a small value for L1, the problems associated with limitations in circuit startup performance and limitations in achieving a wide dimming range are removed.

An improved electronic LCD backlighting inverter circuit is provided for performing high frequency dimming with a low frequency modulation. The improved electronic LCD backlighting inverter circuit is preferably a voltage-fed push-pull LLC resonant circuit which includes: an LLC resonant circuit including a resonant inductor, a magnetizing inductor and a resonant capacitor; switching means for operating said LCD backlighting inverter circuit at a high frequency modulated by a low frequency signal; low frequency signal generator means for generating a low frequency signal, said low frequency signal having positive and negative going portions; logic means for controlling said switching means and being driven from said low frequency signal, said logic means for extinguishing the operation of said switching means during said negative portion of said low frequency signal thereby causing said electronic LCD backlighting inverter circuit to be frequency modulated by said low frequency signal.

BRIEF DESCRIPTION OF THE DRAWINGS

The foregoing features of the present invention will become more readily apparent and may be understood by referring to the following detailed description of an illustrative embodiment of the present invention, taken in conjunction With the accompanying drawings, in which.

DETAILED DESCRIPTION OF THE PREFERRED EMBODIMENTS

Figure 3:
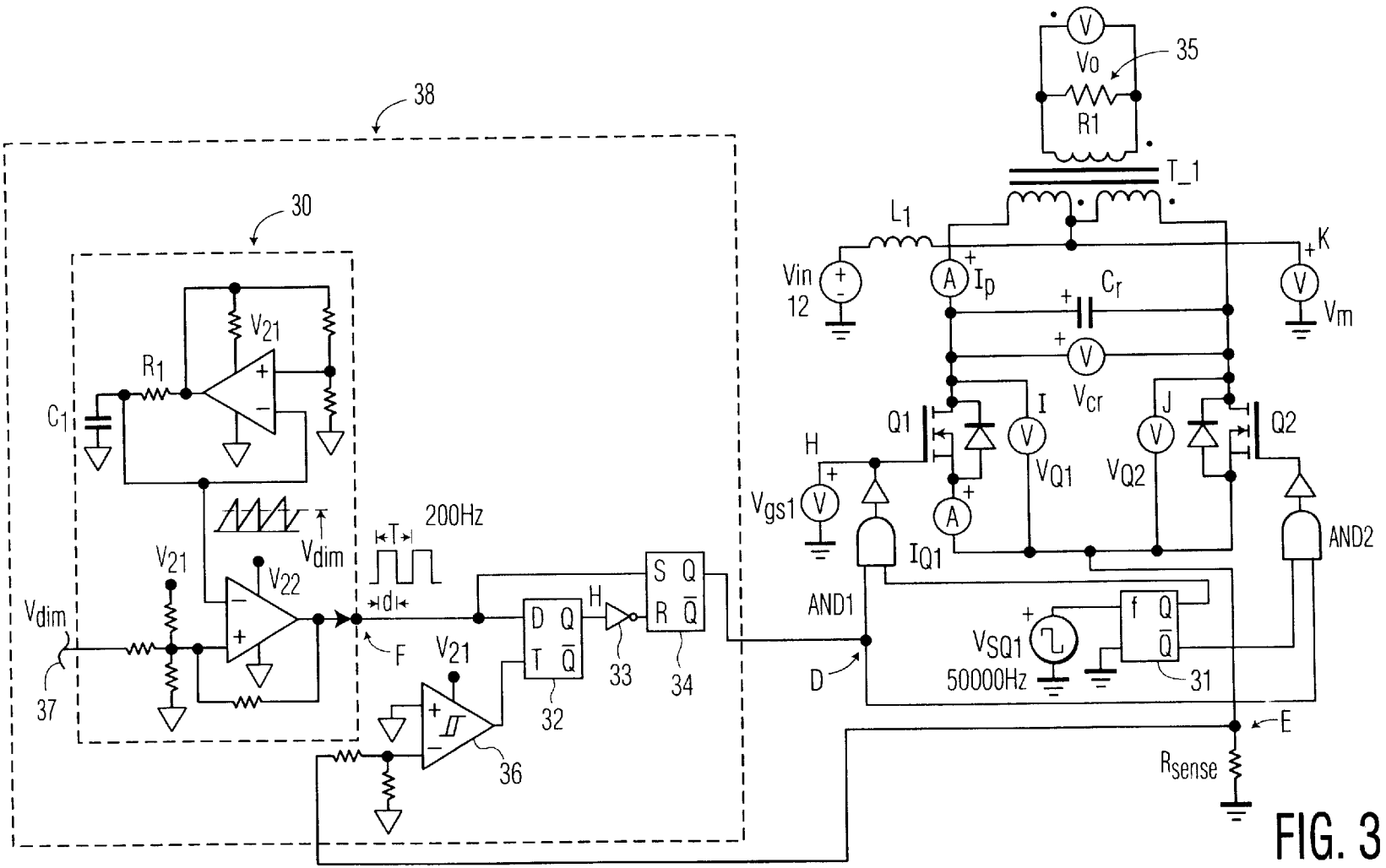
FIG. 3 is a circuit diagram illustrating an LCD backlighting inverter circuit in accordance with an embodiment of the present invention.

Turning now to the drawings, in which like reference numerals identify similar or identical elements throughout the several views, FIG. 3 illustrates an electronic LCD backlighting inverter circuit 10 according to the present invention. It is envisioned that the improved circuit according to the present invention will be used in LCD backlighting applications.

The LCD backlighting inverter circuit 10 according to the present invention is a voltage-fed push-pull LLC resonant circuit for operating a load 35. The load 35 shown in FIG. 3 is shown to be resistive, however, the load can be, but is not limited to a fluorescent lamp of the cold cathode type (e.g., CCFL). The light from load 35 can be used to illuminate, for instance, a LCD flat panel display of a computer (not shown). The backlighting inverter circuit 10 may be powered from a conventional AC power source which is then rectified and converted to provide the DC source voltage used by the backlighting inverter circuit 10.

The LCD backlighting inverter circuit 10 of the present invention provides two important advantages over LCD backlighting inverter circuits of the prior art. First, the LCD backlighting inverter circuit 10 of the present invention is more efficient than LCD backlighting inverter circuits of the prior art. Second, the LCD backlighting inverter circuit 10 of the present invention has a wider dimming range than backlighting inverter circuits of the prior art. Each advantage will be discussed below. The general circuit operation will first be described.

General Circuit Operation

The operation of the circuit arrangement shown in FIG. 3 is as follows. The backlighting inverter circuit 10 operates in two intervals, a first interval defined as [t_0, t_1], and a second interval [t_1, t_2] in each high frequency switching cycle. Assuming steady state, in the first interval [t_0, t_1], at time t_0, switching transistor Q1 turns on and switching transistor Q2 turns off. The voltage across Q2 is equal to the voltage across the resonant capacitor Cr (See $V_{cr}$, waveform 4*f*), which gradually becomes fully charged, as can be seen at point B in waveform 4*f*, via resonance with the input inductor L1 and the magnetizing inductance of T_1. The output transformer T_1 primary current $I_p$ (See, waveform 4*a*) is the sum of the resonant capacitor current $I_{cr}$ (See waveform 4*b*) and the resonant inductor current $I_{L1}$ (See FIG. 4*a*, waveform 4*c*). The current in the resonant capacitor $I_{cr}$ is larger than the resonant inductor current $I_{L1}$. The switching transistors Q1 and Q2 only carry the resonant inductor current $I_{L1}$. The resonant capacitor current $I_{cr}$ is sinked through load 35.

When the resonant capacitor voltage $V_{cr}$ (See waveform 4*f*) reaches zero through a half resonance period at t_1, switching transistor Q1 is turned off and Q2 is turned on with zero voltage switching. The second half resonant period [t_1, t_2] is symmetric to the first half resonant period [t_0, t_1], as shown in waveforms 4*a* and 4*e*, and waveform 4*f*. The gate driving voltage at point $V_{gs1}$ is shown at point H in the inventive circuit of FIG. 3 and is shown at waveform 4*g1*. Voltage $V_{gs1}$ represents a logic level associated with the output of AND gate AND1. Voltage $V_{Q1}$ (waveform 4*h*) corresponds to the voltage at point I in FIG. 3; the same waveform would appear at point J. These voltages represent the voltage across the switching transistors Q1 and Q2, respectively. Voltage $V_m$ (waveform 4*i*) corresponds to the voltage at point K of FIG. 3 and represents the voltage applied to the middle point of the primary winding of transformer T_1.

It is also noted that the inductor current $I_{L1}$ (See FIG. 4*a*, waveform 4*c*) is almost a pure sinusoidal waveform. It is noted that resonant inductor L1 is designed such that the resonant inductor current $I_{L1}$ reaches zero during each high frequency switching cycle, (see point C on FIG. 4*a*, waveform 4*c*). By reaching a zero level in each switching cycle it is therefore possible to synchronize a low frequency PWM signal with the $I_{L1}$ zero points to simultaneously switch off switching transistors Q1 and Q2, effectively shutting down the resonant inductor to facilitate low frequency PWM dimming, as will be described below.

Higher Efficiency

Figure 2:
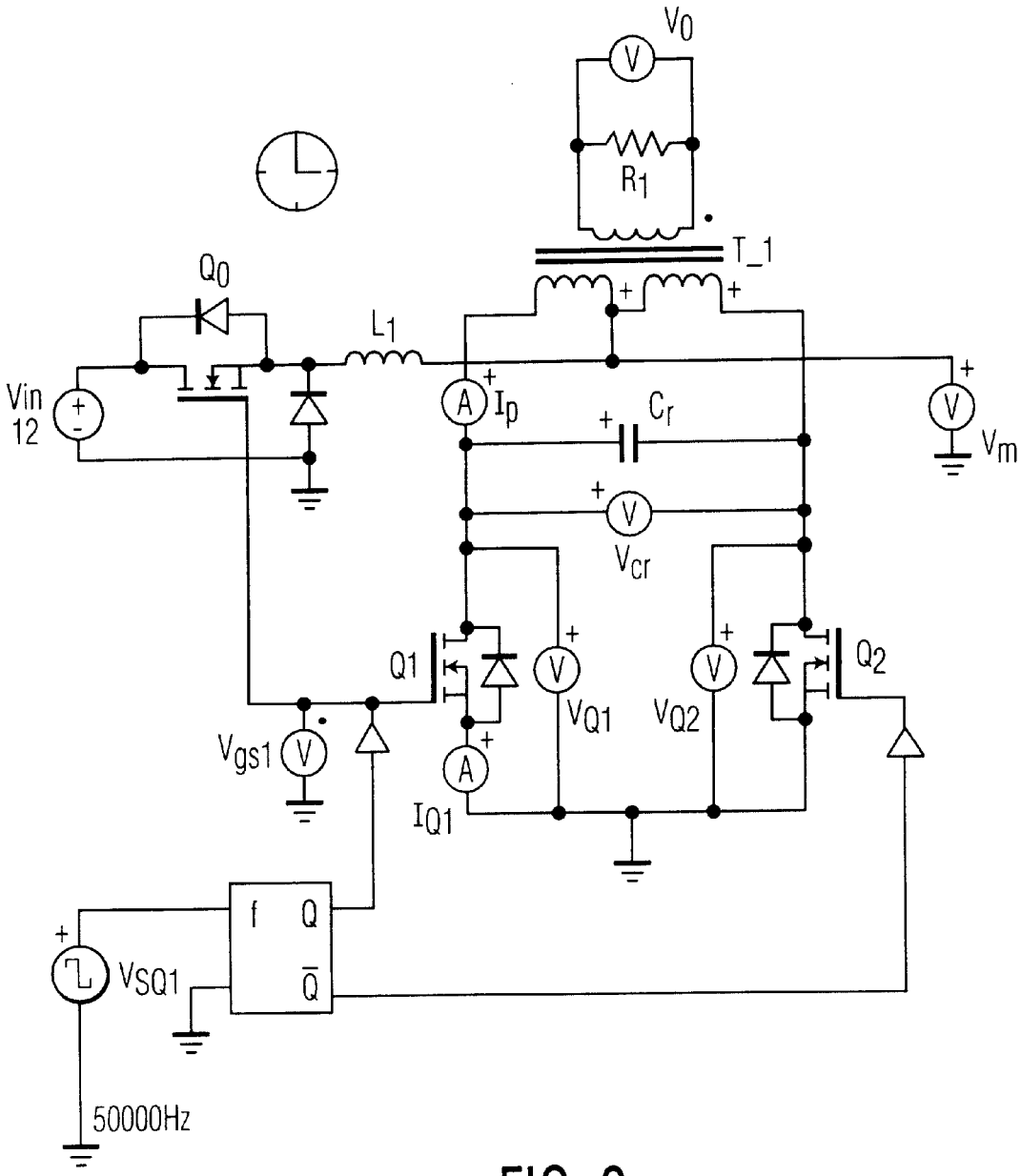
FIG. 2 (PRIOR ART)
FIG. 2 is a circuit diagram illustrating an LCD backlighting inverter circuit of the prior art.

As illustrated in FIG. 3, in one embodiment of the LCD backlighting inverter circuit 10, load 35 is connected to a secondary winding of a transformer T_1. A resonant LLC circuit is formed by resonant inductor L1, load 35, the magnetizing inductance of transformer T_1 and the resonant capacitor $C_r$. The inductance value selected for L1 is typically on the order of 20–30 micro-henries. Such values are significantly lower than inductance values associated with prior art circuit configurations, as illustrated in FIG. 2. Typical inductance values for the circuit configuration of FIG. 2 are on the order of 150–300 micro-henries. It is well known that current driven push-pull configurations require higher inductance values, typically on the order of 150–300 microhenries, depending upon the circuit operating frequency, to ensure an almost constant current. The lower inductance value of the inductor L1 of the present invention changes the circuit configuration from a current-fed parallel resonant circuit to voltage-fed LLC series resonant circuit which is a more efficient circuit configuration. The lower inductance value of L1 is realizable because the push-pull LLC circuit of the present invention is voltage driven, in contrast with the prior art circuit, as illustrated in FIG. 2, which is current driven.

Figure 1:
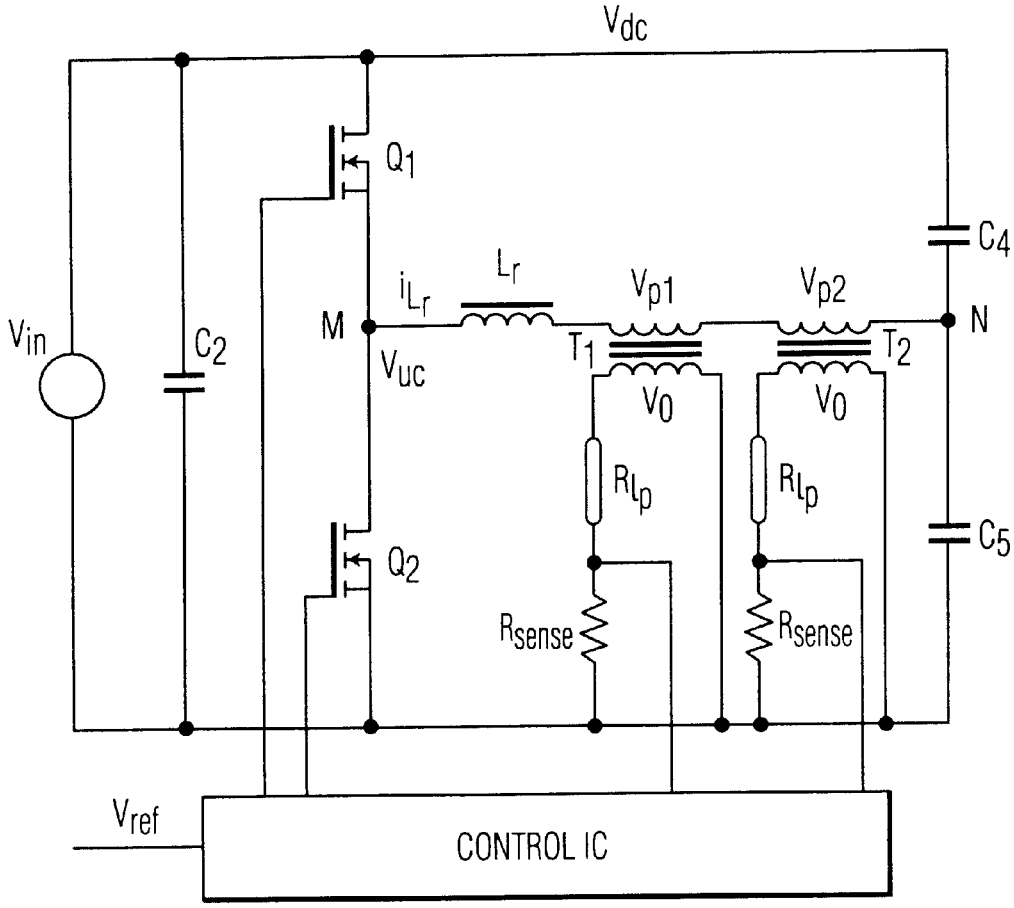
FIG. 1 (PRIOR ART)
FIG. 1 is a circuit diagram illustrating an LCD backlighting inverter circuit of the prior art.

Referring now to the prior art circuit of FIG. 1, it is noted that although this circuit is voltage driven, which is a more efficient circuit configuration, the inductance value cannot realize low values because a high inductance value of $L_r$ is needed in order to convert the voltage source $V_{in}$ to a current source. Therefore, in the prior art circuit of FIG. 1, because of the large inductance value, the inductor is not a component of the resonant tank. By contrast, because of the circuit configuration of the inventive circuit of FIG. 3, the inductor L1 is a component of the resonant tank. Accordingly, its value can be much smaller than the prior art circuit of FIG. 1.

Figure 4A:
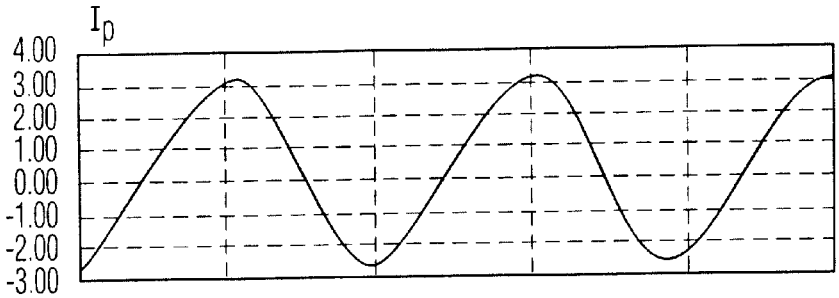
FIGS. 4*a* and 4*b* illustrate representative waveforms present in the circuit of FIG. 3.
Figure 4B:
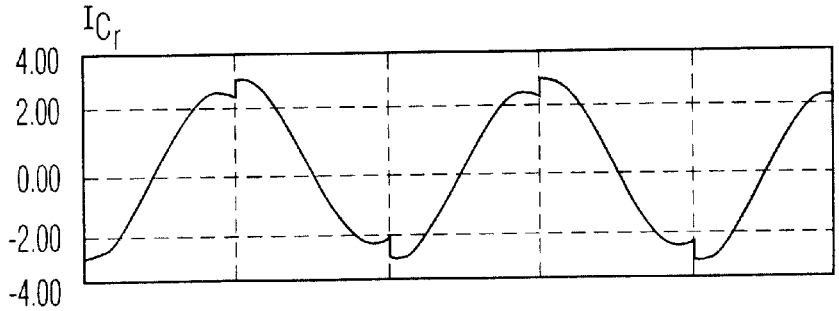
Figure 4C:
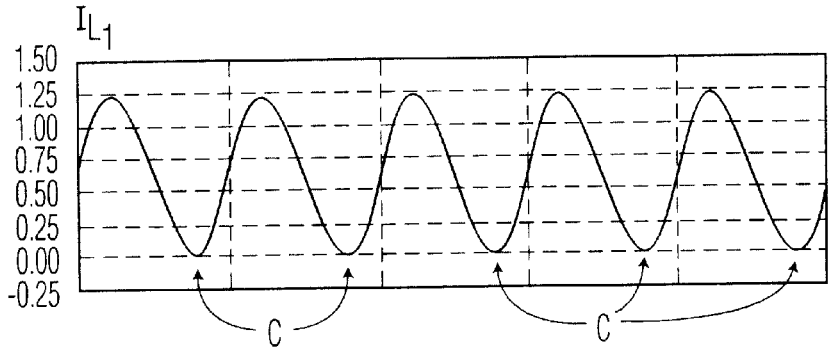
Figure 4D:
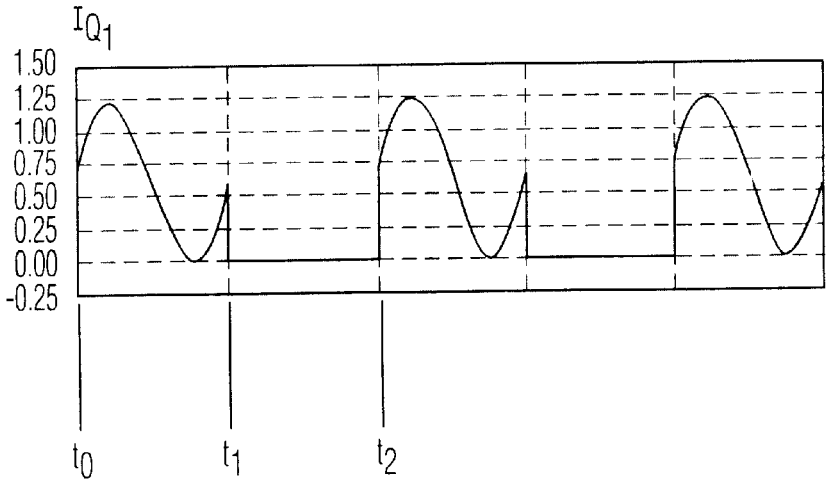
Figure 4E:
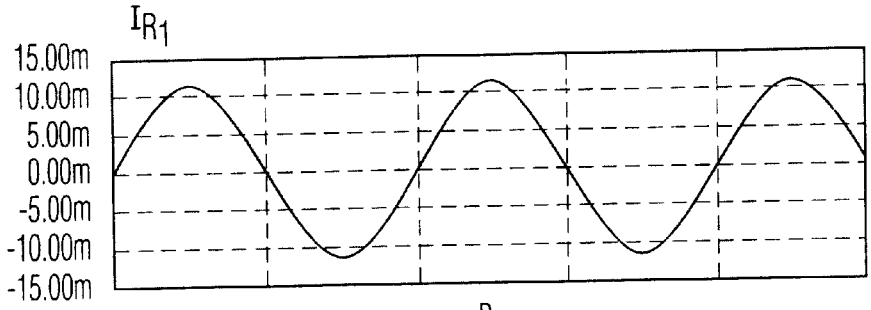
Figure 4F:
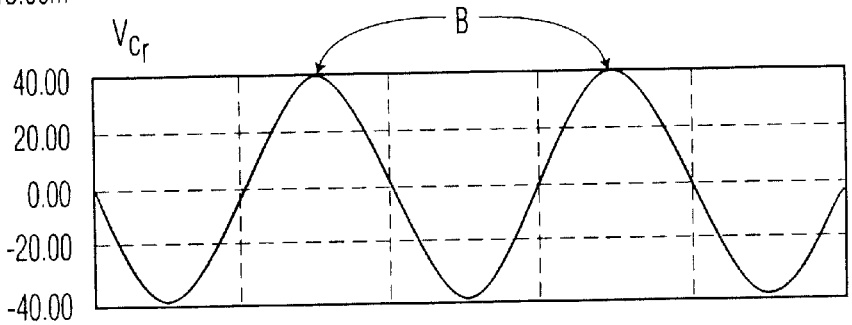
Figure 4G:
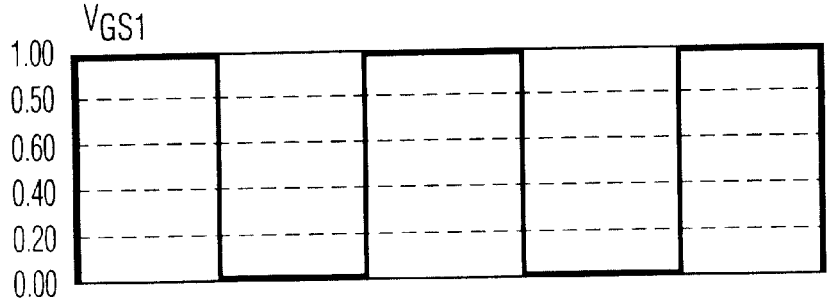
Figure 4H:
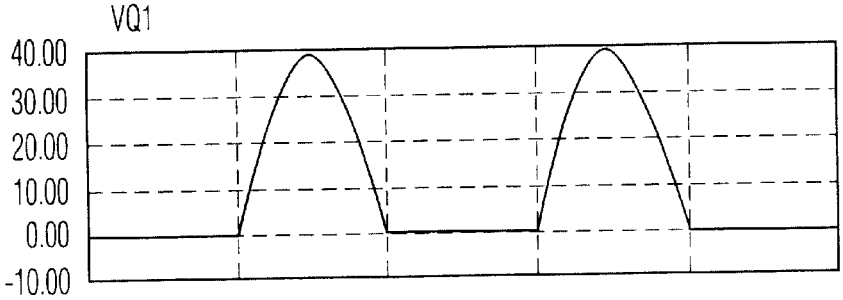
Figure 4I:
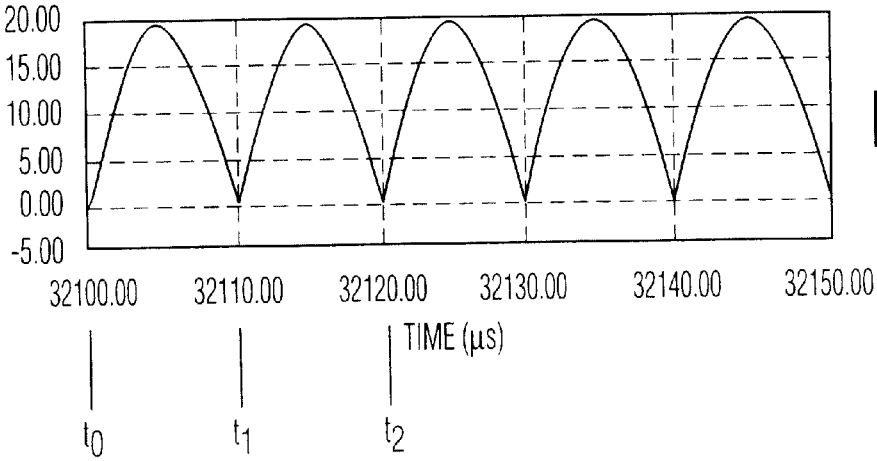

The inductance value of inductor L1 in the present circuit configuration is small enough to be considered part of a resonant circuit formed by the inductor L1, load 35, and the magnetizing inductance of transformer T1 (not shown), and the, resonant capacitor $C_r$. Another desirable consequence of the inductor L1 being one component of the resonant circuit is that the inductor current is substantially sinusoidal, with a certain DC bias, as shown in FIG. 4*a* waveform 4*c*. An AC current (e.g., a sinusoidal current) is required to synchronize a low frequency PWM signal (200 Hz) with the *IL1* zero points to simultaneously switch off switching transistors Q1 and Q2, effectively shutting down the resonant inductor, to enable low frequency PWM dimming, as will be described below.

Another feature of the present invention which contributes to higher circuit efficiency is the use of a smaller transformer turns ratio for transformer T_1 which leads to lower conduction losses in the windings.

In sum, the LCD backlighting inverter circuit 10 of the present invention achieves higher efficiency than LCD backlighting inverter circuits of the prior art in a number of ways including: using a voltage-fed push pull configuration obviating the need for a Buck regulator which is inherently inefficient; using a small inductance value for inductor L1 which contributes to higher circuit efficiency; and using a smaller transformer turns ratio for transformer T_1.

Low Frequency PWM Dimming

In addition to providing higher efficiency over conventional LCD backlighting inverter circuits, the LCD backlighting inverter circuit 10 of the present invention achieves a wider dimming range than conventional LCD backlighting inverter circuits.

It is a feature of the present invention that the backlighting inverter circuit 10 is optimally designed for a fixed full output (i.e., high frequency switching as seen in FIG. 3, VSQ1=50 kHz); however, the backlighting inverter circuit 10 is also capable of operating in a low frequency pulse-width modulated (PWM) switching mode) when desired. The combination of high frequency switching and low frequency PWM switching provides a wider dimming range than can be achieved in conventional LCD backlighting inverter circuits. Low frequency PWM switching is realized in the present invention using logic control with synchronization. This approach is in contrast with conventional approaches, such as the circuit of FIG. 2, which uses a switching transistor, Q0 to control the lamp dimming level. In the circuit of FIG. 2, the typical dimming range is 30% to 100% of the full output value. By contrast, the dimming range of the present invention is approximately 3% to 100% of a full output value.

Referring to FIG. 3, there is shown a first signal generator means (i.e., a low frequency PWM signal generator 30) which outputs a 200 Hz square wave at point F. The 200 Hz output is sourced to the D input of the D flip flop 32. Both inputs of the D flip flop 32 are leading edge triggered. The 200 Hz signal generated from the low frequency PWM signal generator 30 is also supplied to the SET input of an RS flip flop 34, which is also leading edge triggered. The Q output of the RS flip flop 34 is connected to a first input of respective AND gates, AND1 and AND2. Also shown in FIG. 3 is a resistor RSENSE from which a voltage is developed at point E ranging substantially from 0 to 0.5 volts. A zero voltage is developed at point E at the zero points of the resonant inductor current $I_{L1}$.

Low frequency PWM dimming is generally achieved by synchronizing the zero points (See point C in waveform diagram 4*c* of FIG. 4*a*) in the resonant inductor current $I_{L1}$ during each high frequency switching cycle with the negative going edge of the 200 Hz signal generated from the low frequency PWM signal generator 30. That is, the circuit configuration switches off switching transistors Q1 and Q2 at the 200 Hz rate in synchronization with the zero points of inductor current $I_{L1}$. Synchronization is required because turning off switching transistors Q1 and Q2 at a point other than the zero point of inductor current $I_{L1}$ would not allow the energy stored in the resonant inductor L1 to be smoothly dissipated. At the zero points of the inductor current $I_{L1}$ the stored energy is zero or near zero.

Referring now to the waveform diagrams of FIGS. 3, 4*a*, 4*b* and 5. In operation, the 200 Hz signal generated from the low frequency PWM signal generator 30, shown in FIG. 5*a*, is simultaneously supplied to the D input of the D flip flop 32, and to the S input of the RS flip flop 34. Referring to waveform 5*a* in FIG. 5, the leading edge of one cycle of the 200 Hz waveform is indicated as reference numeral 501. The RS flip flop 34 follows waveform 5*a* and is therefore a logic high 503 at the leading edge 501 of the 200 Hz waveform. Accordingly, the first input of respective AND gates AND1 and AND2 are a logic high at the leading edge 501.

Figure 5A:
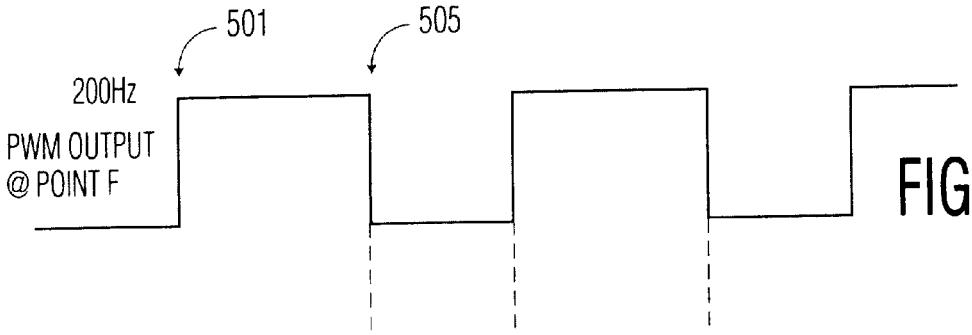
FIG. 5 illustrates timing diagrams of certain signals present in the circuit of FIG. 3.
Figure 5B:
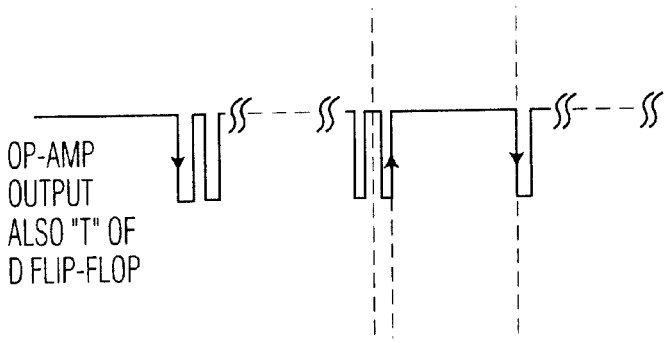
Figure 5C:
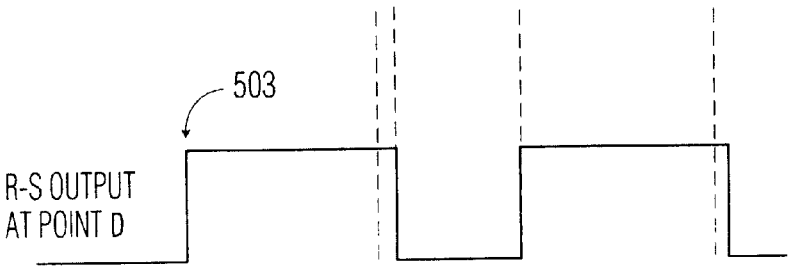

The T input of the D flip flop 32 is connected to the output of op-amp 36 which outputs a 50 kHz output ranging from 0 to 0.5 volts as illustrated in FIG. 5*b* of FIG. 5 in response to a voltage developed at point E at resistor RSENSE. The T input of the D flip flop 32 is leading edge triggered and latches the 200 Hz waveform at the D input on each leading edge of the 50 kHz waveform which is received at the T input, as illustrated in FIG. 5*b*. Given the two inputs to the D flip flop 32 as described, the Q output of the D flip flop tracks the 200 Hz input at a 50 kHz latch rate.

The Q output of the D flip flop 32 is connected to the RESET input of the RS flip flop 34 via a logic inverter 33. As stated above, the Q output of the D flip flop 32 tracks the 200 Hz input waveform at a 50 kHz latch rate. As a consequence of being negative edge triggered, the RS flip flop 34 is reset at each negative going edge (e.g., see point 505 of waveform 5*a* of FIG. 5) of the 200 Hz waveform causing the Q output to be a logic low which in turn causes the respective first inputs to AND gates AND1 and AND2 to be a logic low at a 200 Hz rate. As a result, both Q1 and Q2 are turned off at a point at which the current in inductor L1 is substantially zero.

Referring again to FIG. 3, it is noted that the respective second inputs to the AND gates are connected to a second signal generator means (i.e., a 50 kHz source, VSQ1) via the RS flip flop 31. It is noted that the output of AND gates AND1 and AND2 are 50 Khz waveforms (sourced from respective second inputs), modulated by the 200 Hz waveform (sourced from respective first inputs), where the 200 Hz modulating waveform is synchronized with the zero points of the inductor current $I_{L1}$.

It is also noted that the low frequency PWM signal generator 30 further includes dimming control knob 37 for controlling the duty ratio of the 200 Hz output signal from zero to 100%. A 0% duty ratio corresponds to a DC level zero voltage output, and a 100% duty ratio corresponds to a DC level 5V output.

While the invention is susceptible to various modifications and alternative forms, specific embodiments thereof have been shown by way of example in the drawings and have been described in detail. It should be understood, however, that it is not intended to limit the invention to the particular forms disclosed, but on the contrary, the intention is to cover all modifications, equivalents and alternatives falling within the spirit and scope of the invention as defined by the appended claims.

What is claimed is:

1. An improved electronic LCD backlighting inverter circuit for performing high frequency dimming with a low frequency modulation, said improved electronic LCD backlighting inverter circuit comprising:

switching means for operating said LCD backlighting inverter circuit at a high frequency modulated by a low frequency signal;

low frequency signal generator means for generating said low frequency signal, said low frequency signal having positive and negative portions; and logic means for controlling said switching means and being driven from said low frequency signal, said logic means extinguishing the operation of said switching means during said negative portion of said low frequency signal thereby causing said electronic LCD backlighting inverter circuit to be frequency modulated by said low frequency signal.

2. The improved LCD backlighting inverter circuit of claim 1, wherein said low frequency signal comprises a low-frequency pulse-width modulation signal.

3. The improved LCD backlighting inverter circuit of claim 1, which further comprises a voltage-fed push-pull LLC resonant circuit including a resonant inductor, a magnetizing inductor and a resonant capacitor.

4. The improved electronic LCD backlighting inverter circuit of claim 3, further comprising:

synchronizing means for synchronizing a substantially minimum level of a substantially alternating inductor current associated with said resonant inductor with said low frequency signal to enable said switching means to be switched off.

5. The improved LCD backlighting inverter circuit of claim 1, wherein said improved backlighting inverter circuit comprises a voltage-fed push-pull LC resonant circuit including a resonant inductor, and a resonant capacitor.

6. The improved LCD backlighting inverter circuit of claim 1, wherein said switching means comprises:

a first switching transistor and a second switching transistor; and a signal generator for providing a second signal to said first and second switching transistors to operate said LCD backlighting inverter circuit in said dimming mode.

7. The improved electronic LCD backlighting inverter circuit of claim 1, wherein said switching means comprises first and second switching transistors and said logic means comprises:

a first AND gate connected to said first switching transistor and a second AND gate connected to said second switching transistor, said first and second AND gates having a first input connected to receive said low frequency signal from a low frequency signal source and a second input connected to receive a high frequency signal from a high frequency signal source, said first and second AND gates alternatively outputting a logic high and a logic low during said positive going portion of said low frequency signal, and outputting a logic low during said negative going portion of said low frequency signal.

8. An LCD backlighting inverter circuit comprising:

a high frequency generator;

a low frequency generator;

a switching stage having an output;

a logic means coupled to the high frequency generator and the low frequency generator for controlling said switching stage; and a circuit having a resonant frequency and coupled to the output of the switching stage;

wherein the resonant frequency is formed from a resonant inductor, a load, a magnetizing inductance of a transformer and a resonant capacitor, said resonant inductor having a low inductance value such that it is a part of an LLC resonant circuit with said magnetizing inductance and the resonant capacitor.

9. The LCD backlighting inverter circuit of claim 8, wherein the load is one of a cold cathode fluorescent lamp and a hot cathode fluorescent lamp.

10. The LCD backlighting inverter circuit of claim 9, wherein said cold cathode fluorescent lamp provides lighting for a flat panel display.

11. The LCD backlighting inverter circuit of claim 8, wherein the switching stage includes switching transistors controlled to switch under zero voltage switching turn-on conditions.

12. An inverter circuit for operating a discharge lamp, comprising;

first and second switching transistors, an inductance, a capacitor and a resonant inductor coupled together in a push-pull resonant converter circuit configuration wherein said resonant inductor has an inductance value such that the circuit effectively operates as a voltage-fed push-pull LLC resonant inverter circuit;

a control circuit including logic circuit means for supplying switching signals to control the operation of said first and second switching transistors;

a high frequency signal generator;

a low frequency signal generator, and means for coupling the high frequency signal generator and the low frequency signal generator to the logic circuit means which in turn drives the first and second switching means transistor to operate the inverter circuit at a high frequency modulated by a low frequency modulation signal of the low frequency signal generator.

13. The inverter circuit as claimed in claim 12 further comprising means for synchronizing a high frequency switching signal of the high frequency signal generator and the low frequency modulation signal of the low frequency generator.

14. The inverter circuit as claimed in claim 12 wherein the voltage across the capacitor is approximately sinusoidal and periodically reaches zero voltage at which time one switching transistor is switched off and the other switching transistor is switched on so as to provide zero voltage switching of the first and second switching transistors.

15. The inverter circuit as claimed in claim 12 further comprising:

means for synchronizing a minimum level of an alternating inductor current associated with the resonant inductor with the low frequency signal for switching the first and second transistors off to enable low frequency PWM dimming of the discharge lamp.

16. The inverter circuit as claimed in claim 12 wherein the low frequency signal generator includes means for controlling the duty ratio of the low frequency signal so as to operate the inverter circuit in a low frequency pulse width modulation switching mode for dimming the discharge lamp.

17. The inverter circuit as claimed in claim 12 wherein the logic circuit means terminate operation of the first and second switching transistors during a negative portion of the low frequency signal thereby to frequency modulate the inverter circuit by the low frequency signal.

18. The inverter circuit as claimed in claim 17 wherein said low frequency signal comprises a low frequency pulse with modulation signal for dimming the discharge lamp.

19. The inverter circuit as claimed in claim 12, further comprising:

means coupled to at least one of the switching transistors to derive a synchronizing signal; and second means for coupling the synchronizing signal to the low frequency signal generator to synchronize a high frequency switching signal of the high frequency generator with the low frequency modulation signal.

20. The inverter circuit as claimed in claim 12 further comprising an output transformer having a primary winding coupled to the first and second switching transistors and to a terminal for a source of supply voltage for the inverter circuit via said resonant inductor, wherein said inductance includes the magnetizing inductance of the output transformer, and means for coupling a secondary winding of the transformer to an output circuit adapted for connection to a discharge lamp.

21. The inverter circuit as claimed in claim 12 wherein the resonant inductor inductance value is chosen such that the resonant inductor current reaches a zero level during each high frequency switching cycle, said inverter circuit further comprising:

means for synchronizing the low frequency modulation signal with the zero level of the resonant inductor current, and said logic circuit means is driven by the low frequency modulation signal to control the first and second switching transistors to simultaneously turn off during a negative portion of the low frequency modulation signal.

22. The inverter circuit as claimed in claim 12 wherein the inverter circuit is part of an LCD backlighting circuit for an LCD apparatus, and the switching signals for the first and second switching transistors are independent of an image refresh period of the LCD apparatus.

* * * * *